US005904432A

United States Patent [19]

Ando et al.

[11] Patent Number: 5,904,432

[45] Date of Patent: May 18, 1999

[54] BALLPOINT PEN TIP, MANUFACTURING METHOD THEREFOR, AND BALLPOINT PEN USING THE SAME

[75] Inventors: Masashi Ando; Nobuo Sekine; Masahiro Kondo; Hideaki Asami; Nobuo Matsubara, all of Aichi, Japan

[73] Assignee: The Pilot Ink Co., Ltd., Aichi, Japan

[21] Appl. No.: 08/987,347

[22] Filed: Dec. 9, 1997

Related U.S. Application Data

[62] Division of application No. 08/426,735, Apr. 21, 1995, abandoned.

[30] Foreign Application Priority Data

Apr. 29, 1994 [JP] Japan ..... 6-114581
Apr. 29, 1994 [JP] Japan ..... 6-114582

[51] Int. Cl.[6] ..... B43K 7/00

[52] U.S. Cl. ..... 401/209; 401/216

[58] Field of Search ..... 401/209, 216, 401/210, 211, 212, 213, 214, 215

[56] References Cited

U.S. PATENT DOCUMENTS

| | | | |
|---|---|---|---|
| 2,879,586 | 3/1959 | Fehling et al. | 401/216 |
| 2,957,453 | 10/1960 | Eckerle | 401/209 |
| 4,311,403 | 1/1982 | Liguori | 401/209 |
| 4,457,644 | 7/1984 | Yokosuka | 401/216 |
| 4,789,263 | 12/1988 | Germann | 401/216 |

FOREIGN PATENT DOCUMENTS

| | | | |
|---|---|---|---|
| A1 0066541 | 12/1982 | European Pat. Off. | B43K 1/08 |
| A1 0659589 | 6/1995 | European Pat. Off. | B43K 1/08 |
| 1088078 | 3/1955 | France . | |
| 455568 | 7/1968 | Switzerland . | |
| 714211 | 8/1954 | United Kingdom . | |
| WO 9400304 | 1/1994 | WIPO | B43K 7/00 |

*Primary Examiner*—David J. Walczak
*Attorney, Agent, or Firm*—Sughrue, Mion, Zinn, Macpeak & Seas, PLLC

[57] ABSTRACT

A ballpoint pen tip including a metallic pipe having a plurality of inwardly projecting portions at a neighborhood of a front end portion of the pipe at regular intervals, and a front end edge portion at a front end of the pipe, and a ball rotatably held between the front end edge portion and the plurality of inwardly projecting portions, wherein the pipe satisfies a relation of $A/T \leqq 5.8$ where A is an outer diameter of the ball and T is a thickness 10 of the pipe, and also the relation of $B/T \leqq 2.3$ where B is a diameter of a virtual inscribing circle contacting a top of the plurality of inwardly projecting portions and T is the same as above.

4 Claims, 7 Drawing Sheets

BALLPOINT PEN TIP, MANUFACTURING METHOD THEREFOR, AND BALLPOINT PEN USING THE SAME

This is a divisional of application Ser. No. 08/426,735 filed Apr. 21, 1995 now abandon.

BACKGROUND OF THE INVENTION

1. Field of the Invention

This invention relates to a ballpoint pen tip, manufacturing method therefor and ballpoint pen using it. More specifically, the present invention relates to a ballpoint pen tip rotatably holding a ball at the front end thereof by a plurality of inwardly projecting portions for a ball receiving seat which is formed by inwardly compressing and deforming the periphery of a neighborhood of the front end of a metallic pipe and a front end edge portion which is formed by inwardly compressing and deforming the front end of the pipe, a manufacturing method and a ballpoint pen using it.

2. Description of the Related Art

U.S. Pat. No. 4,457,644 discloses a conventional ballpoint pen tip rotatably holding a ball at the front end thereof by a plurality of inwardly projecting portions for a ball receiving seat which is formed by inwardly compressing and deforming the periphery of the neighborhood of the front end of a metallic pipe and a front end edge portion which is formed by inwardly compressing and deforming the front end of the pipe.

However, this conventional ballpoint pen tip does not take into account the thickness of the metallic pipe. Namely, the thickness of the pipe with respect to the ball size is set to be relatively thin so that the side of the metallic pipe can be easily compressed and deformed. Accordingly, a ball receiving seat does not have a sufficient strength due to the thinness of the inwardly projecting portion. During writing, since the ball receiving seat can not support the ball when a strong writing force is applied, it may be spread outwardly by the ball. Therefore, the ball bites at the ball receiving portion, thereby preventing its smooth rotation, and the ball gradually falls into the pipe, thereby losing a stable and smooth writing feeling. The smaller the ball size is, the more this phenomenon occurs.

Further, the top portion of the inwardly projecting portion of the conventional ballpoint pen tip has a relatively small radius of curvature. Accordingly, the surface of the top portion of the inwardly projecting portion is easily cracked by the compressing and deforming. Therefore, the cracking gives a user an unpleasant feeling with the ball rotation during writing.

SUMMARY OF THE INVENTION

It is an object of the present invention to provide a ballpoint pen tip having a strong ball receiving seat, and giving a user a smooth writing feeling for a long time without cracking the ball receiving seat, and a ballpoint pen using it.

A ballpoint pen tip of the present invention is comprised of a metallic pipe having a plurality of inwardly projecting portions for a ball receiving seat which are formed by inwardly deforming a neighborhood of a front end portion of the pipe at regular intervals, and a front end edge portion which is formed by inwardly deforming a front end of the pipe; and a ball which is rotatably held between the front end edge portion and the plurality of inwardly projecting portions; wherein the pipe satisfies a relation of $A/T \leqq 5.8$ where A is an outer diameter of the ball and T is a thickness of the pipe.

Accordingly, such a ballpoint pen tip satisfies the above relation, namely, that ratio is smaller than that of the conventional ballpoint pen tip, so as to obtain the ball receiving seat having sufficient strength corresponding to the size of the ball. Therefore, the smooth and stable writing can be maintained for a long time. In addition, the value of A/T is preferably equal to or more than 2.5. If it is less than 2.5, the thickness of the pipe is much thicker than the outer diameter of the ball, such that it is difficult to deform the pipe.

BRIEF DESCRIPTION OF THE DRAWINGS

In the accompanying drawings.

DETAILED DESCRIPTION OF THE PREFERRED EMBODIMENTS

Figure 1:
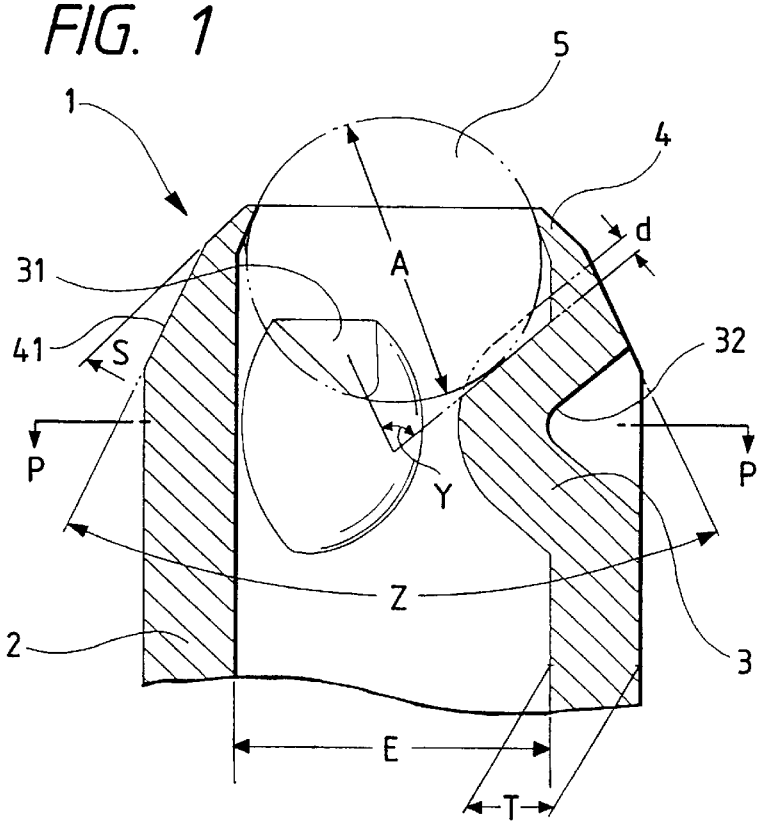
FIG. 1 is a sectional view showing a main portion of a first embodiment of a ballpoint pen tip of the present invention.
Figure 2:
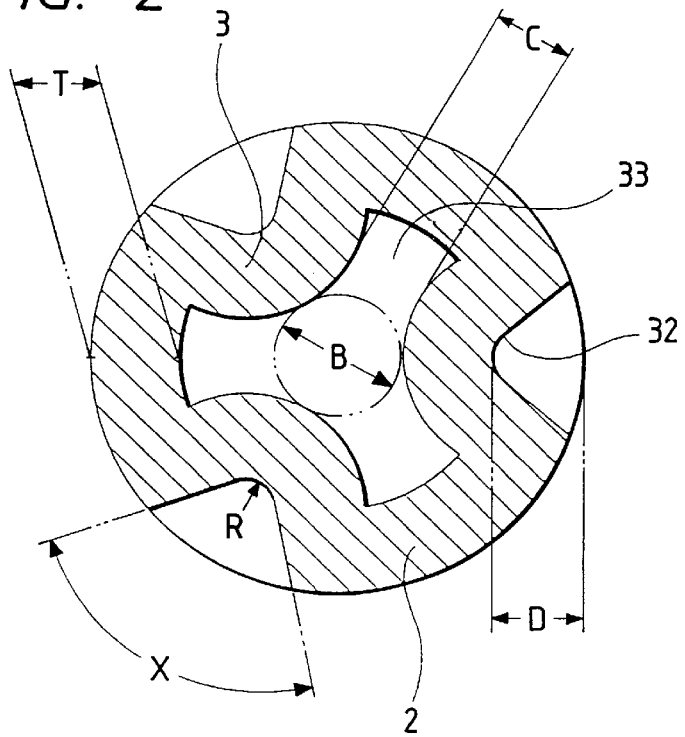
FIG. 2 is a cross sectional view of P—P line in FIG. 1.
Figure 3:
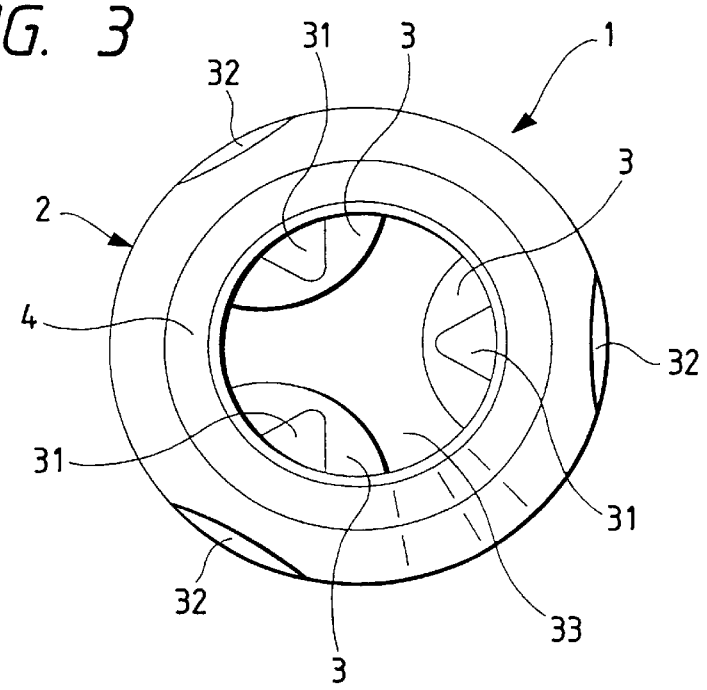
FIG. 3 is a plan view of FIG. 1.

FIGS. 1, 2 and 3 show a ballpoint pen tip 1 of the present invention having three inwardly projecting portions 3.

Figure 4:
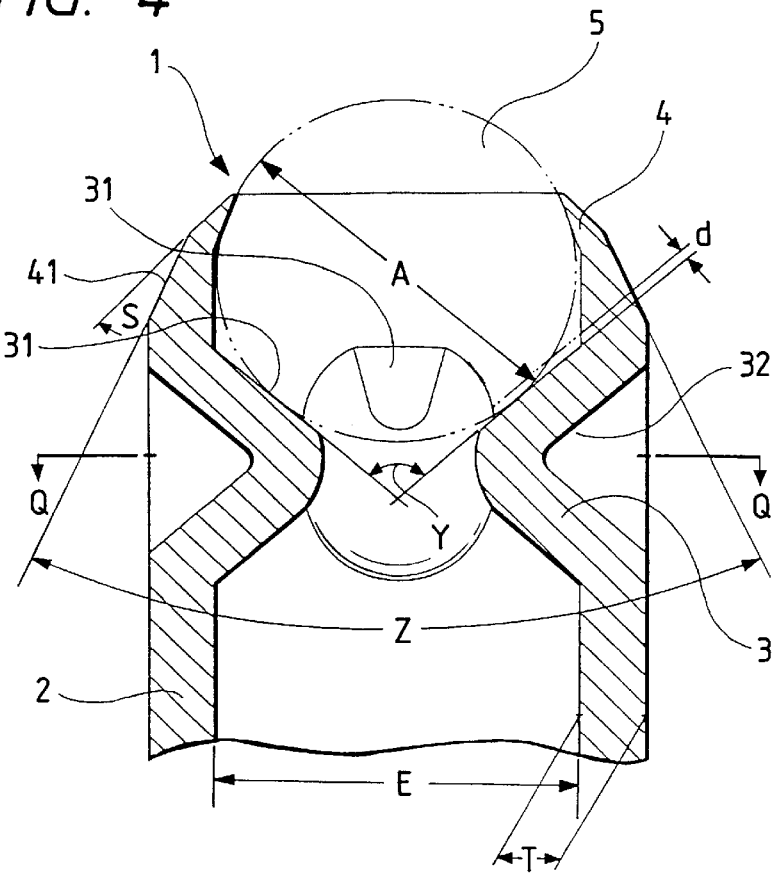
FIG. 4 is a sectional view showing a main portion of a second embodiment of the ballpoint pen tip of the present invention.
Figure 5:
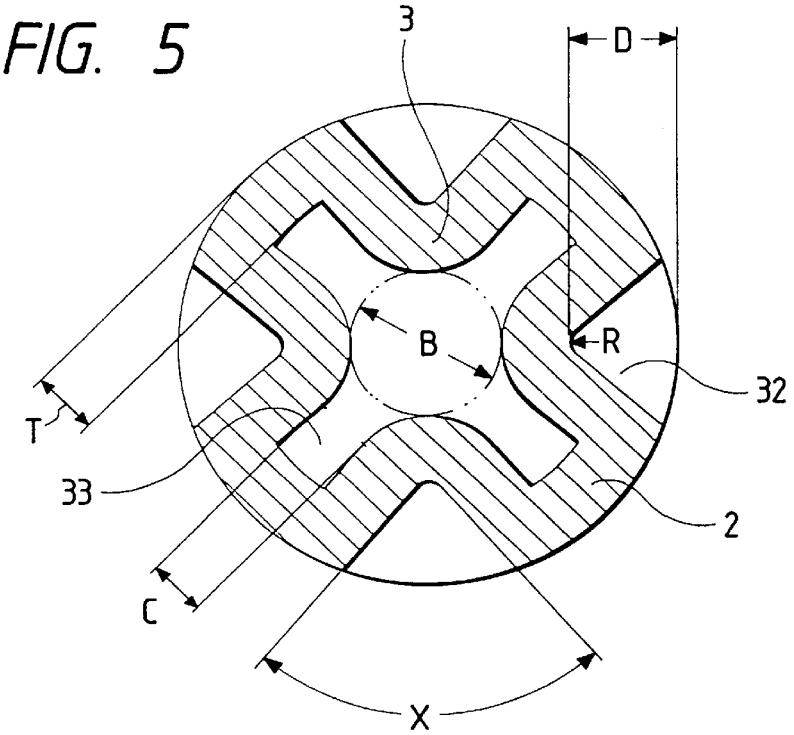
FIG. 5 is a cross sectional view of Q—Q line in FIG. 4.

FIGS. 4 and 5 shows the ballpoint pen tip 1 of the present invention having four inwardly projecting portions 3. Table 1 shows sizes of respective portions on which symbols are put down in these drawings. As shown in table I, five balls 5 having an outer diameter A of 0.3 mm, 0.4 mm, 0.5 mm, 0.7 mm and 1.0 mm respectively are used in this embodiment, and further, suitable ranges for the respective ball diameter of a pipe thickness T and a diameter B of a virtual inscribing circle inscribing at a top point of the inwardly projecting portion 3 are indicated. Here, the pipe thickness T is not a thickness of the inwardly projecting portion 3 or a front end edge portion 4 where its thickness is changed by compressing and deforming, but is that of a front end portion of a pipe 2 (that of a neighborhood of the inwardly projection portion 3) where is not compressed and deformed, or an average thickness of the front end portion of the pipe 2 before forming the inwardly projecting portion 3.

TABLE I

| A (mm) | T (mm) | A/T | B (mm) | B/T |
|---|---|---|---|---|
| 0.3 | 0.08–0.10 | 3.0–3.8 | 0.11–0.15 | 1.1–1.9 |
| 0.4 | 0.10–0.12 | 3.3–4.0 | 0.12–0.16 | 1.0–1.6 |
| 0.5 | 0.13–0.15 | 3.3–3.9 | 0.14–0.18 | 0.9–1.2 |
| 0.7 | 0.12–0.14 | 5.0–5.8 | 0.23–0.27 | 1.6–2.3 |
| 1.0 | 0.18–0.21 | 4.8–5.5 | 0.27–0.31 | 1.3–1.7 |

An ultra hard alloy, stainless steel, ruby, ceramic or the like is suitable for a material of the ball 5. A suitable material for the pipe 2 is stainless steel, and further austenitic stainless steel (e.g. SUS304, SUS305, SUS321 or the like) is more preferable. Too hard a surface of the stainless steel causes the pipe to crack during the compressing and deforming. On the other hand, if it is too soft, the pipe 2 is easily bent during writing. Accordingly, Vickers hardness of the surface of the pipe 2 is set in the range of 150 to 300, preferably, 200 to 240.

An inner diameter of the pipe 2 is set to be 0.01 to 0.05 mm larger than the outer diameter A of the ball. More specifically, if the outer diameter A of the ball is equal to or less than 0.55 mm, the inner diameter of the pipe 2 is approximately 0.01 to 0.03 mm larger than the outer diameter A of the ball. Further, if the outer diameter A of the ball is larger than 0.55 mm, the inner diameter of the pipe 2 is approximately 0.02 to 0.05 mm larger than the outer diameter A of the ball.

A method for manufacturing the ball pen tip 1 of the present invention will be described as follows.

Figure 13:
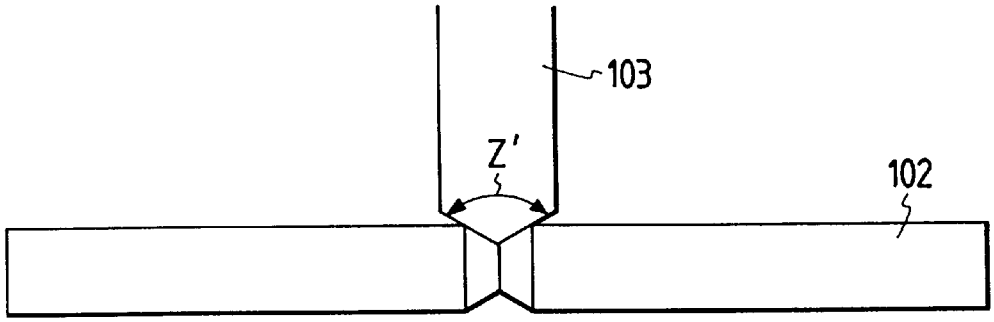
FIG. 13 is an explanation view showing a method for cutting a pipe.

As shown in FIG. 13, under a condition where a core stick is inserted into the metallic pipe 102 having a longitudinal length of 12 mm and a substantially uniform thickness, the side wall of the metallic pipe 102 is plastically deformed so as to be divided into two equal parts by a rotating blade 103 having an included angle of Z'=130°. Owing to the included angle of the rotating blade 103, a circular-cone-shaped taper surface 41 having a Z angle of 50° at the end portion of the each pipe 2 as shown in FIG. 1. The Z angle is preferable in the range of 45° to 75°. The included angle of the rotating blade for manufacturing it is set to an angle of (180−Z)°.

Figure 14A:
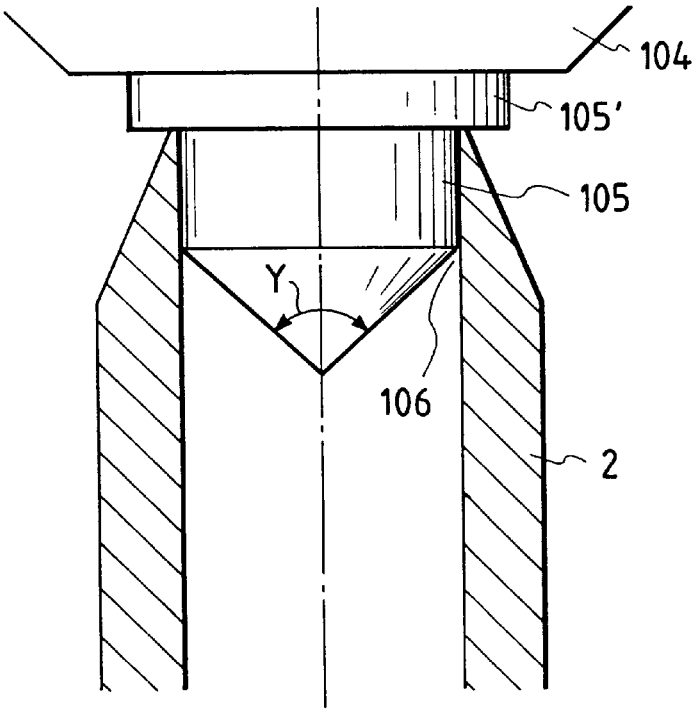
FIGS. 14A to 14C are explanation views showing a method for manufacturing a ballpoint pen tip of the present invention.
Figure 14B:
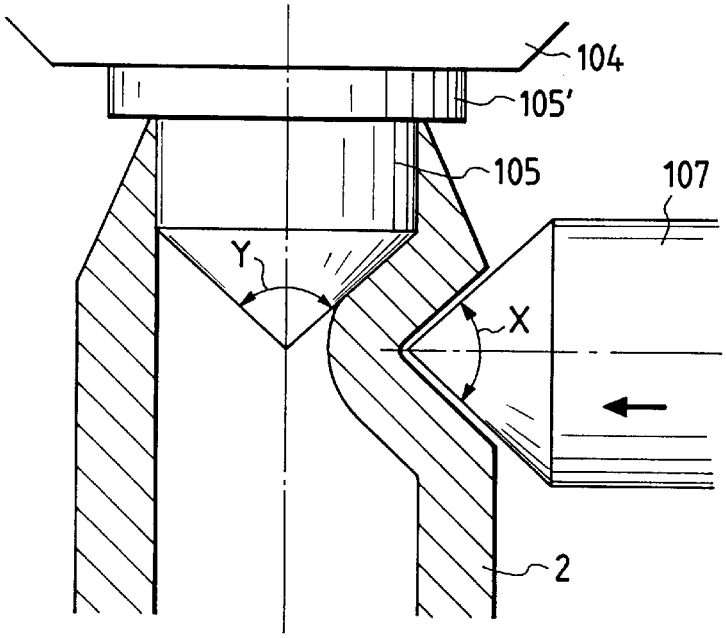

Next, as shown in FIG. 14A, a steepled guide pin 105 having a steeple angle (Y=98°) which is fixed to a collet chuck 104 is inserted into an opening 106 in the side of the taper surface of the pipe 2 having a longitudinal length of about 6 mm so that a guide pin base 105' is attached to the end of the pipe 2. Then, as show in FIG. 14B, the front end portion of the pipe 2 is put between and compressed by the guide pin 105 and a punch 107 having a steeple angle (X=82°) and a radius of curvature R less than 0.03 mm so that the punch 107 compresses to deform the front end portion inwardly (vertical to an axis line) at regular intervals in three or four directions to form the inwardly projecting portions 3. At this time, as shown in FIG. 1, a coned concave portion 32 (angle X: 82°) is formed at the outside of the inwardly projecting portion 3 and a ball receiving seat 31 having a coned concave portion (angle Y: 98°) is formed at an convex portion in the inside of the inwardly projecting portion 3.

Figure 14C:
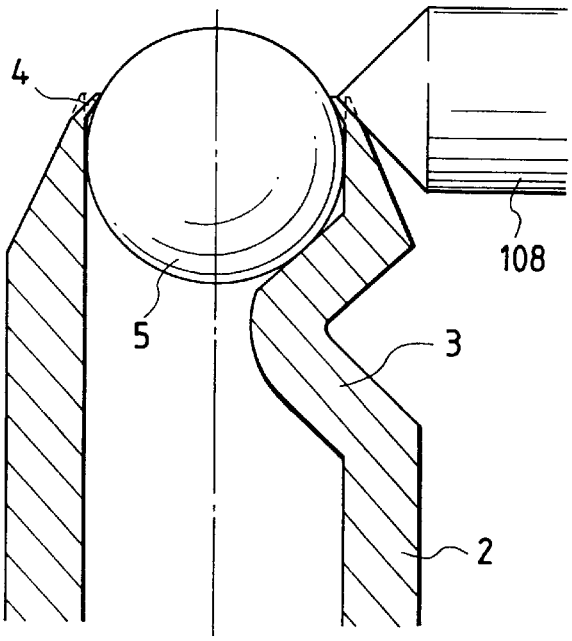

Finally, as shown in FIG. 14C, the ball 5 is accommodated in the front of the ball receiving seats 31, and the front end edge portion 4 of the pipe 2 is compressed and deformed inwardly by a crimping jig 108 including a coned concave surface having an inclined angle of substantially 90° so as to obtain the ballpoint pen tip 1 rotatably holding the ball 5.

In addition, in the above manufacturing method, the ratio of the diameter A of the ball to the thickness T of the pipe T (A/T) is equal to or less than 5.8 (preferably, in the range of 2.5 to 5.8), and/or that of the diameter B of a virtual inscribing circle inscribing at a top point of the inwardly projecting portion 3 to the thickness T of the pipe (B/T) is equal to or less than 2.3 (preferably, in the range of 0.5 to 2.3). Accordingly, the ball receiving seat 31 and the front end edge portion 4 having a sufficient strength against the deformation by writing force can be formed easily.

Especially, if the number of the inwardly projecting portion 3 is three and the outer diameter A of the ball is equal to or less than 0.55 mm (specifically, in the range of 0.25 mm to 0.55 mm, preferably, in the range of 0.25 mm to 0.45 mm), the thickness T of the pipe is preferable to satisfy the relations of $2.5 \leqq A/T \leqq 4.5$ and $0.5 \leqq B/T \leqq 2.0$. On the other hand, if the number of the inwardly projecting portio 3 is four and the outer diameter A of the ball is more than 0.55 mm (specifically, in the range of 0.55 to 1.2 mm, preferably, in the range of 0.6 to 1.1 mm), the thickness T of the pipe is preferable to satisfy the relations of $4.5 \leqq A/T \leqq 5.8$ and $1.0 \leqq B/T \leqq 2.3$.

Owing to the thickness of the pipe in the above range, the thickness T of the pipe is not too large compared with the outer diameter A of the ball and the diameter B of the virtual inscribing circle, so that a large compressing is not necessary force. Therefore, the ball 5 is not damaged when forming the front end edge portion 4, and the ball receiving seat 31 can be easily formed without damaging the top end of the punch 107 when forming the concave portion 32. Further, the thickness T of the pipe is not too small compared to the outer diameter A of the ball and the diameter B of the virtual inscribing circle, thereby forming the ball receiving seat 31 and the front end edge portion 4 having a sufficient strength.

The taper angle S of the front end of the front end edge portion (the taper angle of a front end reduced diameter portion) is set to substantially 90° (specifically, in the range of 85° to 115°). In addition, the taper angle is preferable to be an angle of (Z+40)°.

Moreover, even if a ballpoint pen is inclined with respect to a written surface during writing, the exposure quantity of the ball 5 from the front end of the pipe 2 is in the range of 25% to 35% of the diameter A of the ball (preferably, in the range of 28% to 33% of the diameter A) in order to maintain the contact between the written surface and the ball 5 as much as possible.

The angle Y of the ball receiving seat 31 is set to be in the range of 80° to 140°, preferably in the range of 90° to 110°, more preferably, in the range of 97° to 99°. The reason of this setting is that: if the angle Y is larger than 140°, the top portion of the inwardly projecting portion 31 is cracked, thereby obtaining no smooth rotation of the ball 5, and if the angle Y is smaller than 80°, the ball 5 may bite at the ball receiving seat 31 during writing, thereby preventing the smooth rotation of the ball 5.

On the other hand, the angle X of the concave portion 32 of the inwardly projecting portion 3 is set to be in the range of 40° to 100°, preferably in the range of 70° to 90°, more preferably 80° to 85°. The reason of this setting is that: if the angle is smaller than 40°, the surface of the top portion of the inwardly projecting portion 3 is cracked, and if the angle is larger than 100°, the angle Y of the ball receiving seat 31 is made small so that the ball 5 may bite at the ball receiving seat 31 during writing. Namely, similar to the angle Y, if the angle X is outside the above range, the smooth rotation of the ball is prevented.

The angles X and Y are set so that the sum of the angles X and Y is substantially equal to 180°, preferably in the range of 178° to 182°. Accordingly, the ball receiving seat 31 having a uniformly compressed and deformed state can be obtained.

The concave depth d (the maximum value of the deformation) in the thickness direction of the ball receiving seat 31 is set to be in the range of 0 to 0.05 mm, preferably in the range of 0.01 mm to 0.05 mm, more preferably in the range of 0.01 to 0.03 mm. The linear contact quantity between the ball 5 and the ball receiving seat 31 is adjusted by the concave depth d. Namely, if the linear contact quantity is too large, the ink is insufficient to write so as to prevent the smooth rotation of the ball. Further, if the linear contact quantity is too small, the ball receiving portion 31 is severely worn away and the ball 5 gradually falls into the pipe 2, thereby preventing the smooth rotation of the ball due to the friction between the written surface and the front end of the pipe 2.

The maximum depth D of the concave portion 32 is set to be in the range of 0.1 mm to 0.4 mm, preferably in the range of 0.13 mm to 0.25 mm. Taking account of the strength of the ball receiving seat 31 to be formed, the maximum depth D of the concave portion 32 is in the range of one to two times as thick as the thickness T of the pipe. If the maximum depth D is extremely large, the thickness of the inwardly projecting portion 3 to be formed is much thinner than the thickness T of the pipe, thereby lowering the length of the ball receiving seat 31.

The top portion of the inwardly projecting portion has a substantially spherical surface shape. A radius of curvature of the top portion is set to be in the range of 0.2 to 0.5 times as long as the outer diameter A of the ball. Accordingly, the top portion of the inwardly projecting portion 3 within the above range is free from the cracking due to the compressing and deforming.

Gaps 33 are provided between respective inwardly projecting portions 3. The size C of the gap 33 is set to be in the range of 0.01 mm to 0.12 mm, preferably in the range of 0.06 mm to 0.10 mm in which the gap has an appropriate capillary force. Consequently, owing to the capillary function of the gaps 33, the ink of the appropriate quantity corresponding to the consumption speed thereof is supplied to the ball 5 so that the ink always exists between the ball 5 and the ball receiving seat 31 to allow the smooth writing without broken handwriting. Further, even if the front of the pen is turned upward, the drop back of the ink due to the gravity can be prevented so that the ink is always attached to the back of the ball 5.

Further, if the outer diameter A of the ball is equal to or smaller than 0.55 mm, three inwardly projecting portions 3 are preferably provided at regular intervals. If it is larger than 0.55 mm, four inwardly projection portions 3 are preferably provided at regular intervals. The reason for this setting is that the size of the gaps 33 provided between respective inwardly projecting portions 3 have to be set in the range (namely, 0.01 mm to 0.12 mm) in which the capillary force can act with respect to any ball size. If the outer diameter A of the ball is larger than 0.55 mm and the number of inwardly projecting portion 3 is not four but three, the maximum depth D of the concave portion 32 have to be even deeper than that of the concave portion 32 of the ballpoint pen tip 1 having four inwardly projecting portion. Consequently, the ball receiving seat 31 is extremely thin, thereby lowering its strength.

FIGS. 6 to 12 show ballpoint pens to which the ballpoint pen tip 1 of the present invention is applied.

Figure 6:
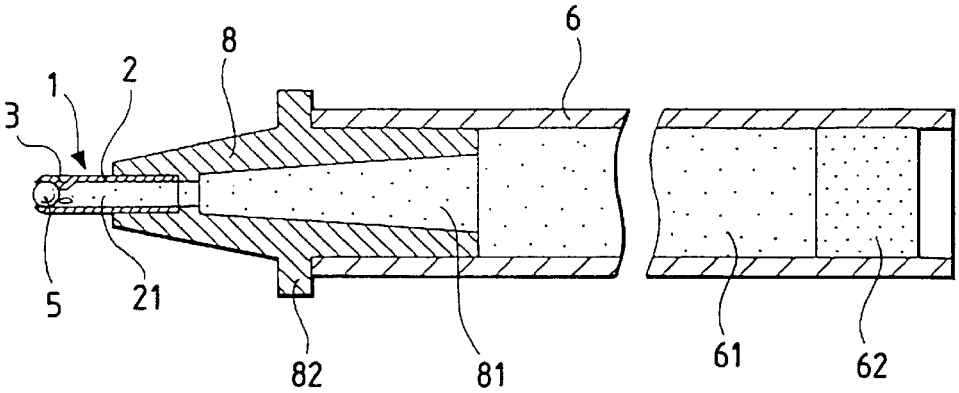
FIG. 6 is a sectional view showing a first embodiment of a ballpoint pen of the present invention.

FIG. 6 shows a first embodiment of the ballpoint pen or a ballpoint pen refill of the present invention. The ballpoint pen is produced in such a manner that: the ballpoint pen tip 1 of the present invention is fixed to the front end of a tube-shaped joint member 8 made of synthetic resin (e.g. polyacetal, polypropylene, polyethylene or the like) by force fitting; and the joint member 8 is fixed to the front end of a transparent or semi-transparent ink reservoir 6 formed by an extrusion molded body made of synthetic resin (e.g. polypropylene, polyethylene or the like) by force fitting. In addition, the outer periphery of the intermediate portion of the joint member 8 is provided with a flange 82 which attaches to the top end opening edge of the ink reservoir 6.

A shear thinning aqueous ink 61 (viscosity: 10 to 150 mPa•s at 20° C. and share rate of 384 $sec^{-1}$) and a viscoelastic ink follower are stored in the ink reservoir 6. Here, the ballpoint pen tip having three inwardly projecting portions 3 and the outer diameter A of the ballpoint pen 1 in the range of 0.25 mm to 0.55 mm, preferably in the range of 0.25 mm to 0.45 mm, is used so as to obtain a thin handwriting width suitable for writing on a pocket notebook or the like. On the other hand, the ballpoint pen tip having four inwardly projecting portions and the outer diameter A of the ballpoint pen 1 in the range of 0.55 mm to 1.2 mm is used so as to obtain a thick handwriting width suitable for writing a signature or the like.

A cylindrical ink introduce control path 21 is formed in the ballpoint pen tip 1 in the rear of the ball 5. Further, an inner hole 81 having a taper-shaped inner surface for communicating the ink introduce control path 21 with the ink reservoir 6 is formed in the joint member 8.

Figure 7:
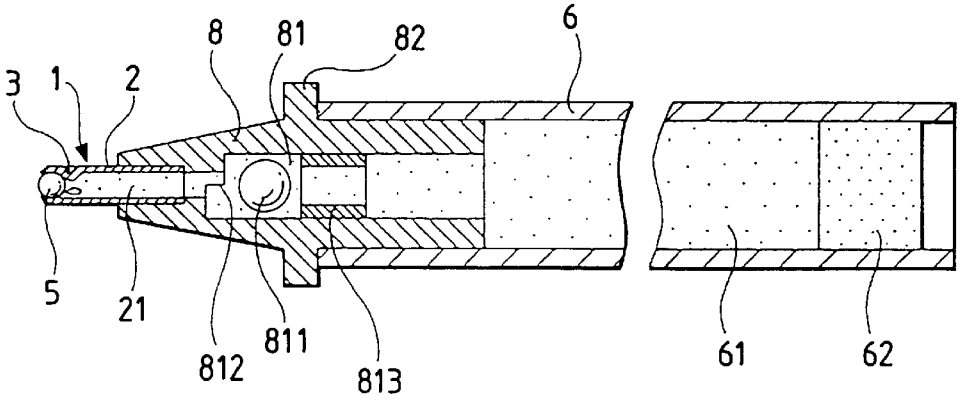
FIG. 7 is a sectional view showing a second embodiment of the ballpoint pen of the present invention.

FIG. 7 shows a second embodiment of the ballpoint pen of the present invention.

A backflow prevention mechanism is provided in the inner hole 81 of the joint member 8. Consequently, the backflow of the ink 61 can be prevented even when the front of the ballpoint pen is turned upward or the ballpoint pen is impacted, such as if it is dropped on the floor.

The backflow prevention mechanism includes a valve ball 811 stored in the inner hole 81 movable forward and backward, a regulating wall 812 attaching to the valve ball 811 moved forward and ensuring the ink flow, and a valve seat 813 closely attaching to the valve ball 811 moved backward. The valve ball 811 is a metallic ball having an outer diameter slightly smaller than the inner diameter of the inner hole 81. The regulating wall 812 is an attaching wall having a notch or a groove which is integrally formed with the inner wall of the inner hole 81. The valve seat 813 is a tube-shaped body made of metal or synthetic resin which is fixed to the inner periphery wall of the inner hole 81 by force fitting. Remaining elements are similar to the first embodiment.

Figure 8:
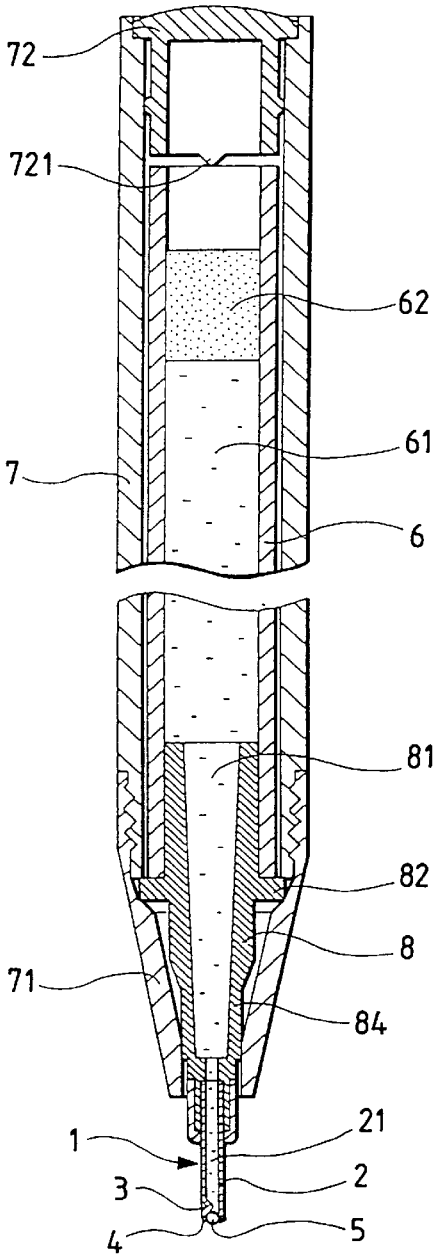
FIG. 8 is a sectional view showing a third embodiment of the ballpoint pen of the present invention.
Figure 9:
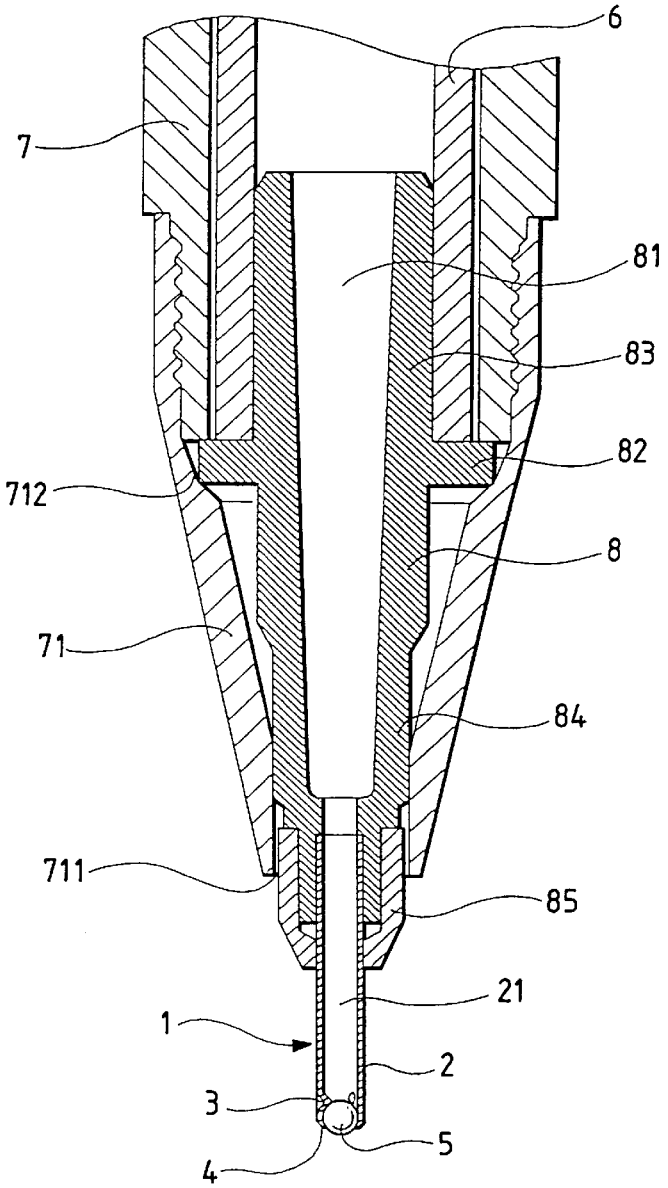
FIG. 9 is an enlarged view of the main portion of FIG. 8.

FIGS. 8 and 9 show a third embodiment of the ballpoint pen of the present invention.

These drawings show a ballpoint pen in which the ballpoint pen refill is accommodated in a penholder 7. The structure of the ballpoint pen refill is substantially similar to that of the ballpoint pen shown in FIG. 6 in which the ballpoint pen tip 1 is connected with the ink reservoir 6 by the joint member 8. The penholder 7 is made of a transparent or semi-transparent synthetic resin. A tapering front body 71 is engaged with the front end of the penholder 7. A tail plug 72 made of synthetic resin painted with substantially the same color as the ink is engaged with the rear end of the penholder 7. A convex portion 721 is formed at the front end of the tail plug 72 so as to compressedly attach the rear end of the ink reservoir 6. The front end of the ballpoint pen tip 1 projects outward from a front end hole 711 of the front body 71.

The inside of the ink reservoir 6 is filled with a medium viscosity ink 61. The medium viscosity ink 61 is an aqueous ink having the viscosity in the range of 10 to 150 mPa•s, preferably in the range of 30 to 100 mPa•s, at 20° C. and the shear rate of 384 $sec^{-1}$, or an oil ink having the viscosity in the range of 1000 to 10000 mPa•s, preferably in the range of 1500 to 9000 mPa•s.

An ink follower 62 (e.g. a greasy viscoelastic ink follower, a solid stopper having a piston-shape made of an elastic member or the like) moving forward with the consumption of the ink is stored in the ink reservoir 6 at the rear of the ink. The ink reservoir 6 and the penholder 7 are made of transparent or semi-transparent synthetic resin so as to easily confirm the consumption state of the ink from the outside.

FIG. 9 is an enlarged view of the main portion of FIG. 8. The joint member 8 is a tube-shaped body made of synthetic resin (e.g. polyacetal, polypropylene, polyethylene or the like) molded by the injection molding. The flange 82 is integrally provided on the outer periphery of the joint member 8. A mounting tube portion 83 is provided at the rear of the flange 82, which is compressedly inserted into the front end opening portion of the ink reservoir 6. In addition, a supporting tube portion 84 is provided at the front of the flange 82, which is compressedly attached to the inner wall of the front end hole 711. Further, the ballpoint pen tip 1 is fixed to the front end of the joint member 8. Still further, a metallic cover member 85 is engaged with the outer periphery of the fixing portion. The swinging or falling of the ballpoint pen tip during writing can be prevented by the cover member 85.

The front end of the flange 82 is compressedly attached to a tapering inner surface 712 of the front body 71. The rear end of the flange 82 is closely attached to the top end edge of the ink reservoir 6 so as to still prevent the leak of the ink as well as attached to the front end edge of the penholder 7. That is, the flange 82 is put between the tapering inner surface 712 of the front body 71 and the front end edge of the penholder 7 and held by them.

The inner hole 81 having the tapering inner surface whose diameter is reduced from the rear portion to the front portion is provided in the inside of the joint member 8. The inner hole 81 is communicated with the hollow and straight ink introduce control path 21 in the ballpoint pen tip 1.

The ink introduce control path 21 at the rear of the inwardly projecting portion 3 of the ballpoint pen tip 1 is set in accordance with the longitudinal size and the inner diameter of the metallic pipe 2 to be applied. Although the preferable length of the pipe 2 is in the range of 3 mm to 10 mm, it is set to about 6 mm in this embodiment. The inner diameter E of the pipe is set to be 0.01 mm to 0.05 mm larger than the outer diameter A of the ball. More specifically, if the outer diameter A of the ball is smaller than 0.55 mm, the inner diameter E is preferably set to be 0.01 mm to 0.03 mm larger than the outer diameter A of the ball. On the other hand, if the outer diameter A of the ball is larger than 0.55 mm, the inner diameter E is preferably set to be 0.02 mm to 0.05 mm larger than the outer diameter A of the ball. When these diameters are set within the above ranges respectively, the ink introduce control path 21 prevents the excess flowing of the ink and works to fulfil its sufficient function to prevent a break in handwriting due to the insufficient ink.

Here, it is preferable to use the medium viscosity ink 61 being an aqueous ink having the viscosity in the range of 10 to 150 mPa•s at 20° C. and the shear rate of 384 $sec^{-1}$.

In the ballpoint pen to which the above shear thinning aqueous ink 61 is applied, the ink 61 stored in the ink reservoir 6 is introduced to the ink introduce control path 21 via the inner hole 81 of the joint member 8. The ink is maintained to be in the medium viscosity state (gel state) in the ink introduce control path 21. On the other hand, the viscosity of the ink 61 positioned at the neighborhood of the front end of the ink introduce control path 21 is decreased by the shearing stress due to the rotation of the ball 5 during writing so that the ink 61 is discharged with fitting to the ball 5. The ink introduce control path 21 acts for adjusting the ink discharging quantity, namely, it adjusts the ink discharging quantity to be in an appropriate range for writing without the excess or insufficient ink flow.

Further, in the ballpoint pen to which the above shear thinning aqueous ink 61 is applied, the gaps 33 having the capillary force formed between respective inwardly projecting portions 3 is provided at the back of the ball 5. The size C of the gap is in the range of 0.01 mm to 0.12 mm, preferably in the range of 0.06 to 0.1 mm. Owing to the capillary force of the gaps 33, the appropriate ink corresponding to its consumption speed can be supplied from the ink introduce control path 21 to the back of the ball 5. The cooperation function of the ink introduce control path 21 and the gaps 33 cause a discharge of the appropriate amount of ink without breaks. Further, even if the ballpoint pen is turned upward, such a cooperation function prevents the backflow of the ink 61 due to the gravity so that the ink 61 is always attached to the back of the ball 5. Preferably, the ink introduce control path 21 has a thin inner diameter. Accordingly, the outer diameter A of the ball has to be smaller than 0.55 mm, preferably smaller than 0.45 mm (e.g. 0.3 mm, 0.4 mm or the like).

In the ballpoint pen to which the above shear thinning aqueous ink 61 is applied, it is preferable to form the ball receiving seat 31 having the coned concave portion at the front of the inwardly projecting portion 3. The ball receiving seat 31 contacts linearly with the ball 5. Therefore, the ballpoint pen tip of the present invention has no disadvantages such as the insufficiency of the ink or the friction of the ball receiving seat 31 which is caused by the conventional contact in a plane or point. Therefore, sufficient ink is always supplied between the ball receiving seat 31 and the ball 5 during writing. Namely, the sufficient ink contacts the back of the ball 5 so as to apply the appropriate shearing stress to the ink 61. As a result of this, it is possible to write smoothly with the ballpoint pen of the present invention, without handwriting breaks.

Further, the above described ballpoint pen with the viscosity of the medium viscosity ink in the range of 10 to 150 mPa•s, preferably in the range of 30 to 100 mPa•s, at 20° C. and the shear rate of 384 $sec^{-1}$ allows the writer to smoothly and appropriately discharge the ink. If the viscosity of the medium viscosity ink is smaller than the above range, it is difficult for the ink 61 to be held in the ballpoint pen tip (especially, in the ink introduce control path 21), thereby causing the dropping of the ink. On the other hand, if it is larger than the above range, the ink 61 does not smoothly flow in the ballpoint pen tip 1, thereby causing the handwriting break.

Figure 10:
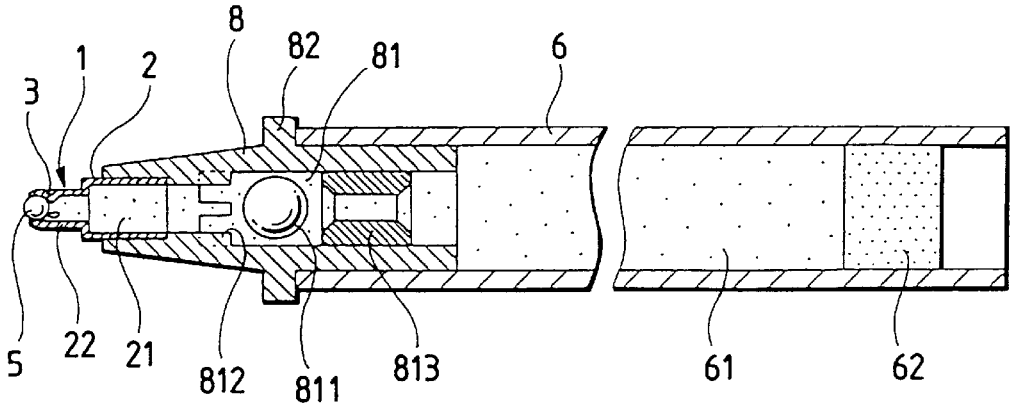
FIG. 10 is a sectional view of a fourth embodiment of the ballpoint pen of the present invention.

FIG. 10 shows a fourth embodiment of the ballpoint pen of the present invention, which is an application example of the first embodiment (FIG. 6).

This drawing shows the ballpoint pen or ballpoint pen refill in which the ballpoint pen tip 1 of the present invention is fixed to the front end of the joint member 8 made of synthetic resin (e.g. polyacetal, polypropylene or the like), and the joint member 8 is compressedly inserted into the front end of the ink reservoir 6 made of synthetic resin (e.g. polypropylene, polyethylene or the like) molded by an injection or an extrusion molding. The ink reservoir 6 is filled with the oil ink 61 having a low or medium viscosity in the range of 1000 to 10000 mPa•s, at 20° C., preferably in the range of 1500 to 9000 mPa•s, and stores the greasy ink follower 62 which moves forward with the ink consumption.

The ballpoint pen tip 1 includes the metallic pipe 2 having a rear portion (outer diameter: 0.65 mm, inner diameter: 0.42 mm) and a front end small diameter portion 22 (outer diameter: 0.5 mm, inner diameter: 0.32 mm). The ball 5 having the outer diameter of 0.3 mm is rotatably held at the front end of the ballpoint pen tip 1. The longitudinal length of the front end small diameter portion 22 is set to be one to three times as long as the outer diameter A of the ball. The shape of the ink introduce control path 21 corresponds to the pipe 2. In addition to this shape, that of the ink introduce control path 21 may have a tapering shape in which the diameter is reduced toward the front end. The shape of the ink introduce control path 21 must be suitable for the viscosity (fluidity) of the ink. Accordingly, the ink discharge quantity without the excess flow of ink and the handwriting break can be surely adjusted. Here, the thickness T of the pipe is the thickness of the front end small diameter portion 22.

The inner hole 81 of the joint member 8 is provided with the backflow prevention mechanism. Consequently, the ink 61 can be surely prevented from backflowing when the top of the ballpoint pen is turned upward or the ballpoint pen is falls on the floor to cause a shock to the pen.

The backflow prevention mechanism includes the valve ball 811 movable forward and backward stored in the inner hole 81, the regulating wall 812 attaching to the valve ball 811 moved forward and ensuring the ink flow, and the valve seat 813 closely attached to the valve ball 811 moved backward. The valve ball 811 is a metallic ball having the outer diameter slightly smaller than the inner diameter of the inner hole 81. The regulating wall 812 has four ribs which are integrally formed with the inner wall of the inner hole 81. The valve seat 813 is an annular body made of synthetic resin or metal having the coned concave surface, and is fixed in the inner hole 81 by force fitting.

Figure 11:
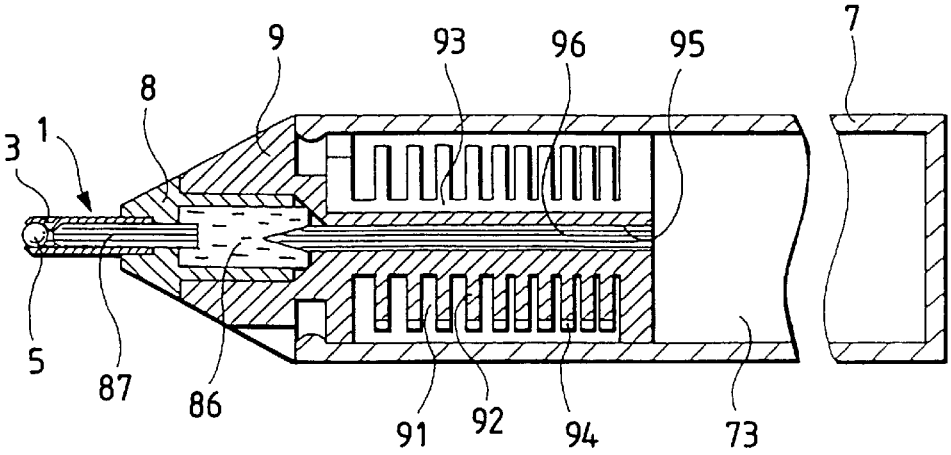
FIG. 11 is a sectional view of a fifth embodiment of the ballpoint pen of the present invention.

FIG. 11 shows a fifth embodiment of the ballpoint pen of the present invention.

A direct liquid type aqueous ink ballpoint pen is shown in FIG. 11, which includes the joint member 8 made of synthetic resin having a front end to which the ballpoint pen tip 1 of the present invention is fixed, an ink holding member 9 having a front end to which the joint member 8 is fixed, and the penholder 7 having a front portion to which the ink holding member 9 is mounted and forming an ink tank 73 for storing a raw ink (low viscosity aqueous ink) at the rear portion thereof.

The ink holding member 9 temporarily holds an overflowed ink corresponding to the pressure change in the ink tank 73. The ink holding member 9 includes comb teeth 92, slit-shaped ink groove 93, an air exchange concave groove 94 and a center hole 95 which are formed integrally by synthetic resin (e.g. ABS resin). The plurality of comb teeth form a plurality of ink holding grooves 91 at the periphery surface of the ink holding member 9. The slit-shaped ink groove 93 is provided at the comb teeth in the axial direction and communicates with the ink holding groove 91. The air exchange concave groove 94 is provided at the comb teeth 92 opposing the slit-shaped ink groove 93.

An ink guide core 96 formed by the extrusion molded body made of synthetic resin is inserted and fixed in the center hole 95. The ink guide core 96 includes an ink introduce path having the capillary force in the axial direction at the outer or inner periphery surface itself. The front end of the ink guide core 96 is stuck into an ink relaying member 86 which is accommodated in the rear portion of the joint member 8. The ink relaying member is made of a porous material body or a fiber worked body. In addition, a stick-shaped body 87 connected to the front end of the ink relaying member 86 for supplying the ink to the back of the ball 5 is provided in the pipe 2 of the ballpoint pen tip 1. The gap having the capillary force is formed between the stick-shaped body 87 and the inner periphery surface of the pipe 2. Accordingly, the aqueous ink is smoothly guided to the back of the ball 5. It may be preferable that a slit having the capillary force for introducing the ink is provided on the outer periphery of the stick-shaped body 8.

Figure 12:
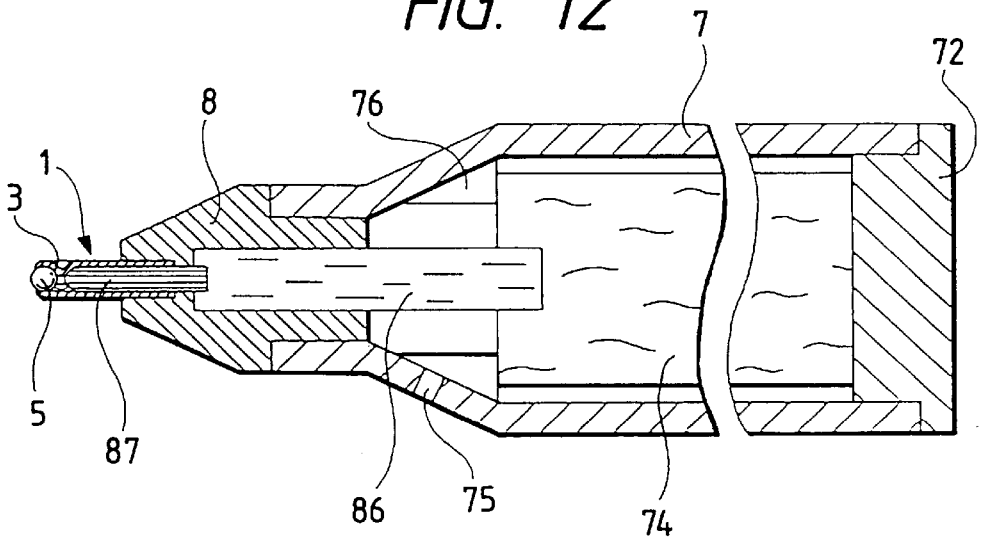
FIG. 12 is a sectional view of a sixth embodiment of the ballpoint pen of the present invention.

FIG. 12 shows a sixth embodiment of the ballpoint pen of the present invention.

An aqueous ink ballpoint pen is shown in FIG. 12, in which the joint member 8 made of synthetic resin having the ballpoint pen tip 1 of the present invention at the front end thereof is inserted into and fixed to the front end of the penholder 7. An ink impregnation body 74 made of the porous material body or the fiber worked body, with which the low viscosity aqueous ink is impregnated, is accommodated in the penholder 7. The ink impregnation body 74 is put between an attaching rib 76 provided on the inner wall of the penholder 7 and the tail plug 72 engaged with the opening portion of the rear end of the penholder 7, and held and fixed by them.

In addition, the ink relaying member 86 connected to the ink impregnation body 74 is mounted in the inside of the joint member 8. The ink relay member 86 is made of the porous material body or the fiber worked body. The stick-shaped body 87 made of synthetic resin is provided in the pipe 2 of the ballpoint pen tip 1, which is connected to the front end of the ink relaying member 86 to supply the ink to the back of the ball 5. The stick-shaped body 87 is a synthetic resin molded body having an ink introducing slit at the outer periphery thereof, a fiber collected worked body or the like. An air hole 75 for communicating the inside of the penholder 7 with the outside is provided in the front of the penholder 7.

Further, in addition to the low viscosity ink, or the low or medium viscosity oil ink, the ballpoint pen tip of the present invention can be applied to a high viscosity painting or applying material such as an adhesive, a cosmetic liquid, an ink erasing liquid or the like.

What is claimed is:

1. A ballpoint pen comprising:

a ballpoint pen tip comprising a metallic pipe having a plurality of inwardly projecting portions for a ball receiving seat which are formed by inwardly deforming a front end portion of said pipe, a front end edge portion which is formed by inwardly deforming a front end of said pipe and an ink introduce control path provided at a rear of said inwardly projecting portions, and a ball which is rotatable held between said front end edge portion and said inwardly projecting portions;

an ink reservoir member for storing an ink and an ink follower accommodated at the rear of the ink in said ink reservoir member for preventing the backflow of the ink therein;

a joint member for joining an inside of said ink reservoir member to said ballpoint pen tip, said joint member having an inner hole therein, wherein an inner diameter of said inner hole is larger than an inner diameter of said ink introduce control path, and wherein said ballpoint pen tip satisfies a relationship of $B/T \leqq 2.3$, where T is a thickness of said pipe, and B is a diameter of a virtual inscribing circle contacting a top of said inwardly projecting portion.

2. A ballpoint pen as claimed in claim 1, wherein an outer diameter of said ball is in the range of 0.25 mm to 1.2 mm, and an inner diameter of the front end portion of said pipe is 0.01 mm to 0.05 mm larger than the outer diameter of said ball.

3. A ballpoint pen as claimed in claim 2, wherein the ink is a shear thinning aqueous ink having a viscosity in the range of 10 to 150 mPa•s at 20° C. and a shear rate of 384 $sec^{-1}$.

4. A ballpoint pen as claimed in claim 2, wherein the ink is an oil ink having a viscosity in the range of 1000 to 10000 mPa•s, at 20° C.

* * * * *